US008905812B2

(12) United States Patent
Pai-Chen

(10) Patent No.: US 8,905,812 B2
(45) Date of Patent: Dec. 9, 2014

(54) TOY BLOCK

(71) Applicant: Cheng Pai-Chen, New Taipei (TW)

(72) Inventor: Cheng Pai-Chen, New Taipei (TW)

( * ) Notice: Subject to any disclaimer, the term of this patent is extended or adjusted under 35 U.S.C. 154(b) by 66 days.

(21) Appl. No.: 13/763,780

(22) Filed: Feb. 11, 2013

(65) Prior Publication Data

US 2014/0227937 A1 Aug. 14, 2014

(51) Int. Cl.
*A63H 33/00* (2006.01)

(52) U.S. Cl.
USPC ..... 446/122; 446/124

(58) Field of Classification Search
USPC ..... 446/120, 122, 124, 127, 128; D21/471, D21/478, 484, 485, 486, 491, 499, 500, 506
IPC ..... A63H 33/04,33/086
See application file for complete search history.

(56) References Cited

U.S. PATENT DOCUMENTS 3,005,282 A 10/1961 Christiansen
3,552,055 A 1/1971 Matsubayashi et al.
3,570,170 A 3/1971 Kishi
D279,915 S 7/1985 Arnau Pibet
4,551,110 A * 11/1985 Selvage et al. ..... 446/118
D285,100 S 8/1986 Volpe
4,823,532 A * 4/1989 Westerburgen ..... 52/592.6
4,964,833 A 10/1990 Suzuki
D340,749 S 10/1993 Lyman
D370,035 S * 5/1996 Olsen ..... D21/491
D378,837 S 4/1997 Olsen et al.
6,050,873 A 4/2000 Reisman
7,416,166 B1 * 8/2008 Shaw ..... 254/88
D612,435 S 3/2010 Sisamos

* cited by examiner

*Primary Examiner* — Vishu K. Mendiratta
(74) *Attorney, Agent, or Firm* — Alan D. Kamrath; Kamrath IP Lawfirm, P.A.

(57) ABSTRACT

A toy block, configured to be assembled with a mating block, has four sidewalls. The toy block includes, where applicable, at least one stud, at least one recessed portion, bottom posts, semi-circle posts, rib pairs, a plurality of edge stoppers, and a plurality of corner stoppers. The studs and the recessed portion are provided at the top side and at the bottom side of the toy block respectively. When one of the studs of the mating toy block is inserted in one of the recessed portions of the toy block, each one of the engaged studs of the mating toy block has its sidewall abutting against eight abutment points in its corresponding recessed portions of the toy block. Thus, the toy block is grasped with the mating toy block at the engaged studs of the mating toy block.

11 Claims, 22 Drawing Sheets

TOY BLOCK

FIELD OF THE DISCLOSURE

The present invention relates to a new system for construction toy blocks and, in particular, to a system allowing a construction toy block to have a maximum of eight abutment points abutting each engaged stud, upon assembling to its mating blocks.

BACKGROUND OF THE INVENTION

In the present day market, the current assembling systems, with construction toy blocks mostly commonly seen, fall under the principle of Circle Square Packing in their system of the assembling workings. However, most of their systems do not fully utilize the number of abutments provided under such principle, which defines an "existing" set of four abutting points on each of the circles abutting against each other.

If one were to image the configuration of all the circles in a Circle Square Packing like a chessboard, the packed circles will fall under two groups: the black group circles and the white group circles. Each of the black circles is situated across its neighboring white circles in a lattice, and vice versa. Also, imagine that an area encompassing a lattice of the white group circles is fixed onto a free moving flat board, and a lattice of the corresponding black group circles within the same area is fixed onto another flat board that is attached to the ground.

FIG. 1A is taking an example block representing a three-abuttment system currently seen on the market, after being assembled (or stacked up, joined) with its mating block on top of the other. For purpose of simplification, the mating block is assumed to be an identical block. This figure shows a "theoretical" cross-sectional schematic plane view, as cut at the bottom of the upper block. The rectangular projection area of the upper block bottom is similar to the aforementioned moving board of the white group circle lattice. The same projection area on the top of the lower block can be imagined as being fixed to the ground, similar to the aforementioned ground board of the black circle lattice.

FIG. 1B is an isometric view showing the two representative prior-art toy blocks detached from each other.

Referring to FIGS. 1A and 1B, a prior-art toy block 10 representing its system has the following features:

- A box-shaped body 11;
- A stud 12, as an example of other studs on the toy block (similar to one of the aforementioned black circles of the black group lattice), being on a top surface (similar to the aforementioned ground board);
- An open space 13, as the hollow interior of the box-shaped body 11, shown on the bottom (similar to the aforementioned moving board);
- A bottom post 14 similar to one of the aforementioned white circles in the white group lattice) being in the shape of a tube, as an example of other bottom posts on the prior-art toy block; and
- A stopper 15, as an example of other stoppers on the prior-art toy block, being incorporated in the open space 13.

When two of the mating prior-art toy blocks 10 are being assembled (or stacked up one on top of the other), the bottom post 14 inside the box-shaped body 11, and the mating stud 12 come to be engaged to each other, with the mating stud 12 only abutting against three abutment points—that is, the tangents between the edge of the mating stud against:

an edge of the bottom post 14; and one edge each on two neighboring stoppers 15.

The number of abutments with the prior-art system is even less than the aforementioned defined set of existing four abutments. Accordingly, the bond inbetween the stud 12 and its three abutments are not as firm as may be desired. As a consequence, the interference fit inbetween the stud 12 at the three abutment points will need to be significant in order to achieve the required firmness of bond under only three abutments. After some use, the engagement bond between the two prior art toy blocks 10 would deteriorate due to friction wear and stress fatigue over time resulting in the prior-art toy blocks 10 becoming loosely engaged upon assembling.

Another shortcoming with the prior-art system is that only the top of the representative prior-art toy block 10 can be engaged with the bottom of its mating block, making the number of combinations with the assembly variety under such system limited.

In addition, FIG. 1C is an isometric view showing the "actual" condition of two mating prior-art toy blocks as joined (stacked up) one on top of the other. The stud 12 is being friction-held only by the three abutting points c1, c2, c3 for binding the toy blocks 10 together. In other words, the bond between the two mating prior-art toy blocks 10 therefore will depend upon the degree of interference fit of the stud against the stopper 15 and against the bottom post 14. As a consequence, the greater the degree (or the level) of interference fit between the stud 12 and the stopper 15 need to be increased for a firm bond, the greater the compression force from the engaged studs coming to exert onto the stopper 15, causing the stopper 15 to bulge outwardly, thereby forming a bulge 11A on the exterior wall of the box-shaped body 11. This will lead to deformation of the box-shaped body 11, consequently further causes causing another shortcoming as explained below.

Please refer to FIG. 1D. FIG. 1D is a schematic side view showing three mating prior-art toy blocks 10 being joined together in an interlocked fashion. In order to accommodate for the bulge 11A expanding outwards onto the sidewall, which is a result of the interference fit between the stud and the stopper, a 10A (shown in FIG. 1E) between two neighboring toy blocks 10 needs to be provided. As a consequence, this gap 10A further leads to weakened strength and integrity of the entire assembly, making insecure joining of the assembly, which tends to disengage upon impact or upon dropping on hard ground.

Accordingly, the subject of how to firmly engage the mating toy blocks with each other, to increase the service life, to a stronger engagement bond, and to a better integrity of the whole toy block assembly when being subjected to external force is worth considering by those skilled in the art.

SUMMARY OF THE INVENTION

The present invention is a new system showing one practical example on the improvements and fuller utilization of the aforementioned Circle Square Packing configuration for interlocking assemblies.

Further to the aforementioned "existing" set of four mutually abutting points on each circle against its neighboring four circle, with each abutment being ninety degrees apart as defined under the principle of Circle Square Packing, this invention system is adding provisions for an "additional" set of four protrusions on each of the aforementioned white group circles, to enable additional abutting points, ready to abut the circles of the aforementioned black group circles upon engagement. These four abutments of the "additional" set on the black group are also 90° apart from each other.

At the same time, the set of the "additional" abutting points are 45° offset, from the aforementioned "existing" set of four abutting points on the black group circles, thus making a total of eight equally or evenly spaced abutment points, that is, one in every 45° spacing ready to abut the white group circles upon engagement of the lattice on the aforementioned moving board (the white group) against that on the aforementioned ground board (the black group).

One example embodiment of this invention is a new system applicable to construction toy building blocks and, particularly, to a toy building block system that enables a maximum of eight abutment points at the bottom side against each engaged stud (or peg), thereby aiding to the reinforcement of the bond.

In addition, as an option, the bottom post can be so designed to have an end cap serving as a solid disc to rigidly engage with the stud.

Also as an option, the wall thickness at the abutting points on both the stud and the bottom post can be intentionally thinned down locally at the interior along the lines of the four abutting points, to form an undercut fit, making it easier for the stud and the bottom post to mutually squeeze and grasp with each other at their respective end cap area upon engagement, hence further aiding to the abutment bond.

Furthermore, derived as a natural consequence from the aforementioned localized thinning of wall thickness at the bottom post interior, a notched hole opening at the stud side is thus formed, allowing an optional, separately designed axle with positioning keys or the like at its stem, to be inserted for further attachment of other rotational toy components available on the market, such as wheels and the like.

Also as an option, either or both the end caps of the stud and the bottom post can be provided with a center hole, to allow an optional, separately designed securing device or the like for a positive securing lock, in the case of applications requiring that the engaged area is to withstand localized, critical stress concentration under certain construction combination designs, such as when the studs function like a knuckle or as a hinge.

In addition, as a variation of the present invention system, in cases where the presence of openings (holes) on the land at the stud side (top side) might be deemed undesirable under different marketing view points, the bottom post can be so designed to eliminate the aforementioned notched hole opening on the land at the stud side. Consequently, the end cap on the bottom post and on the semi-circle posts need to be eliminated, to enable the making, from the bottom side, of a square shaped inner hole or the like in the bottom post and a triangular shaped inner hole or the like in the semi-circle post, serving as their respective material savers. This will, in effect, make four arch-like sidewalls on each of the bottom post and the two arch-like sidewalls on each of the semi-circle posts. The resulting arched sidewalls will exhibit a bridge-like springing and flexing effect under the compression force coming from the engaged studs, thereby improving the abutment bond without the need of an over-interference fit in order to achieve a desired firmness of bond.

Hence, the objective of the present invention is to provide a toy block under the principle of Circle Square Packing, to have a longer service life, more sturdy overall construction, stronger engagement bond, and better integrity of the whole assembly when being subjected to external forces, while aided with a number of optional features for versatility of assembling.

To achieve the aforementioned objectives, the present invention system when applied to toy blocks, is to take full advantage of the aforementioned set of four existing abutment points defined under the principle of Circle Square Packing, plus adding an additional set of four more abutment points, 45° offset from the existing set of four abutments, thereby making a total of eight equally spaced abutment points abutting against each of the engaged studs.

In Specifically, the present invention provides a toy block made of a plastic material and configured to be assembled (or joined) with a mating block of the same Circle Square Packing configuration. It will have four sidewalls looking like a box comprised of at least one stud, at least one recessed portion, at least one bottom post, a plurality of rib pairs, a plurality of semi-circular posts, a plurality of edge stoppers, and a plurality of corner stoppers.

The studs and the recessed portions are provided at the top side and at the bottom side of the toy block, respectively.

The bottom posts are provided at the bottom side of the toy block, surrounded by the recessed portions.

The semi-circular posts are provided at the bottom side of the toy block and protrude from the inner sidewalls of the toy block towards the recessed portions.

The rib pairs are connected between two of the bottom posts, or between the bottom posts and the semi-circular posts. Each of the rib pairs is either arched or with flat walls at both sides. The arch or the flat walls will exhibit a bridge-like springing and flexing effect when subjected to the force of the abutment against the stud.

One corner stopper is provided at each inner corner in the bottom side of the block, aligned towards the center of their respective, nearest bottom post.

The edge stoppers are provided protruding from the inner of the four box-shaped sidewalls towards the recessed portions.

When one or more of the studs of the mating toy is being inserted into one or more of the recessed portions of the toy block, the sidewall of the stud on the mating toy block being assembled will result in abutting against a total of eight abutment points per stud inside the recessed portions of the toy block, thus firmly engaging under such bond of a maximum of eight abutments per each engaged stud.

The foregoing, as well as additional objectives, features, and advantages of the present invention, will be more readily apparent from the following detailed description, which proceeds with reference to the accompanying drawings.

DESCRIPTION OF THE PREFERRED EMBODIMENTS

Figure 2A:
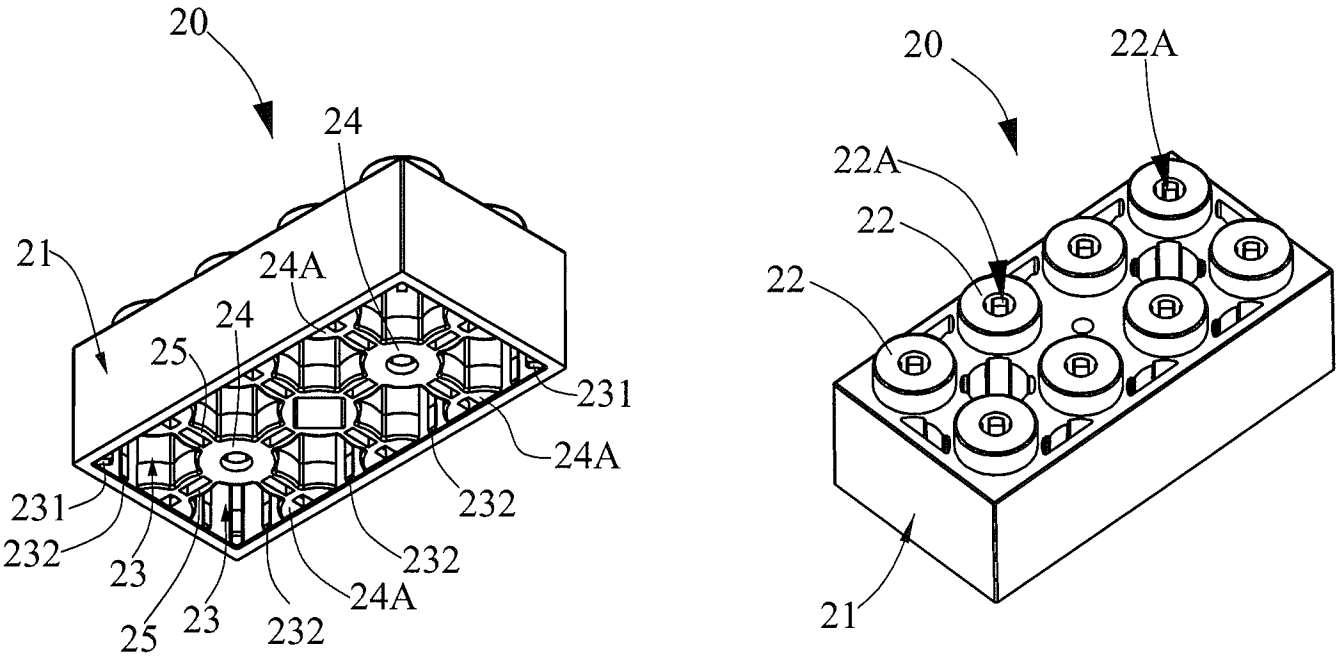
FIG. 2A shows a representative toy block 20 as the first embodiment incorporating the present invention.

FIG. 2A shows a representative eight-studs toy block 20 as one example embodiment incorporating the present invention system. Referring to FIG. 2A and FIG. 2C, a representative toy block 20, made of a plastic material, has four sidewalls 21 looking like a box. This toy block 20 also has eight studs 22 at the top side hereof, and the eight studs 22 are arranged in an array or a lattice. The number of studs can be either increased or decreased or can be in a different array according to the intended size and coverage of each toy block application.

The toy block 20, or its variation of different sizes, has at the bottom, at least one of:

- stud 22,
- recessed portion 23,
- bottom post 24 (for those with more than three studs), and
- a plurality of:
  - semi-circular posts 24A (for those with more than one stud),
  - rib pairs 25 (for those with more than one stud,
  - edge stoppers 231, and
  - corner stoppers 232.

The recessed portions 23 and the studs 22 are along common axes, with the recessed portions 23 vertically beneath the studs 22. The four sidewalls 21, looking like a box, surround the recessed portions 23. Four of the recessed portions 23 surround one of the bottom posts 24.

The bottom posts 24 are hollow columns.

The semi-circle posts 24A protrude from the sidewalls 21 of the toy block 20. The semi-circle posts 24A are, in fact, the cropped half of the bottom posts according to the principle of Circle Square Packing.

In this representative eight-stud block of the first example embodiment incorporating the invention system, two of the rib pairs 25 are connected between two of the bottom posts 24. Moreover, the remaining eight of the Rib Pairs 25 are connected between the bottom posts 24 and the semi-circular posts 24A.

The rib pairs 25 are of hollow walls having either a flat wall or an arch shaped protrusion on both of the rib exteriors, protruding into the corresponding recessed portions 23 and ready to abut an engaged stud. Each of the arch shaped ribs, in effect, becomes an arched bridge and exhibits a bridge-like springing and flexing effect under the compression force coming from the stud 22 upon engagement, thereby enhancing the bond against the stud 22.

The edge stoppers 231 are positioned in the recessed portions 23, at the inner sides of the box-like sidewalls 21 of the toy block 20, and positioned at the middle of the center distance inbetween two neighboring semi-circle posts, or inbetween that of a semi-circle post and its neighboring corner stoppers 232.

In addition, the corner stoppers 232 are positioned at the four inner corners of the sidewalls 21 and aligned towards the center of the nearest bottom post at a 45° degree angle. The corner stoppers 232 are, in fact, simplified versions of a cropped quarter of a bottom post 24.

Hence, the bottom posts together with their cropped versions form a total of four abutment points 90° apart from each other surrounding each stud upon engagement. This set of four abutting points can be regarded as the already "existing" set, under the principle of Circle Square Packing.

The corner stoppers also serve to counter-act against any possible outward expansion of the edge stoppers 231 when the later engages a stud.

The edge stoppers 231 and the rib pairs 25 together form an "additional" set of four abutment points, also 90° apart from each other, ready to abut each engaged stud. This set of four additional abutments are 45° offset from the aforementioned "existing" set of four abutments, making a total of eight equally spaced abutments ready to abut each engaged stud.

Figure 3A:
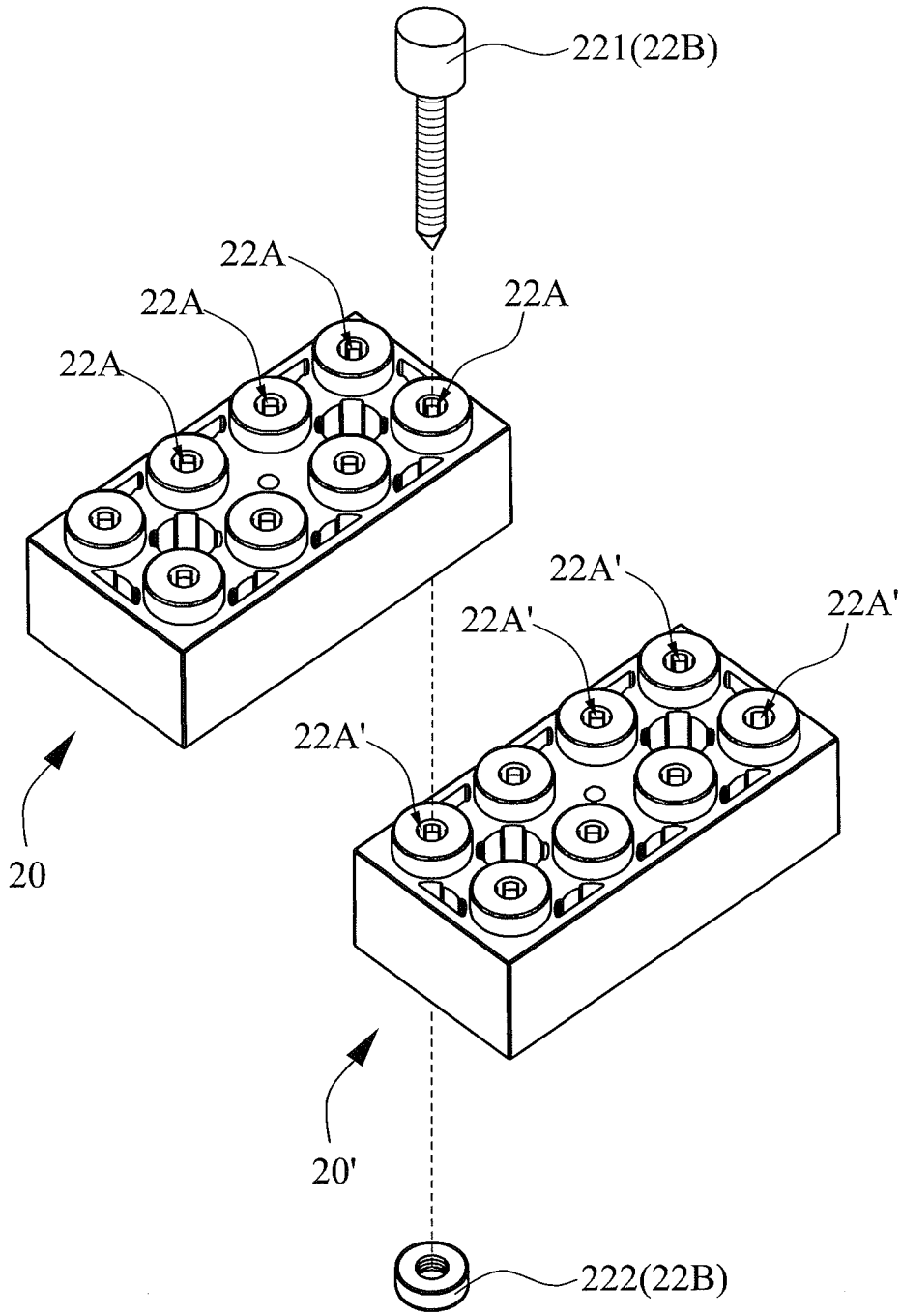
FIG. 3A is an explosive view showing the example mating toy blocks 20 and 20' being joined together by an optional securing (or locking) device 22B.

The optional through-hole 22A is intended to allow an optional, separately designed securing screw 221 of FIG. 3A to pass through and secure to a nut 222, in case of applications that require the engaged area to withstand localized, critical stress concentration under certain construction combination designs.

Figure 2B:
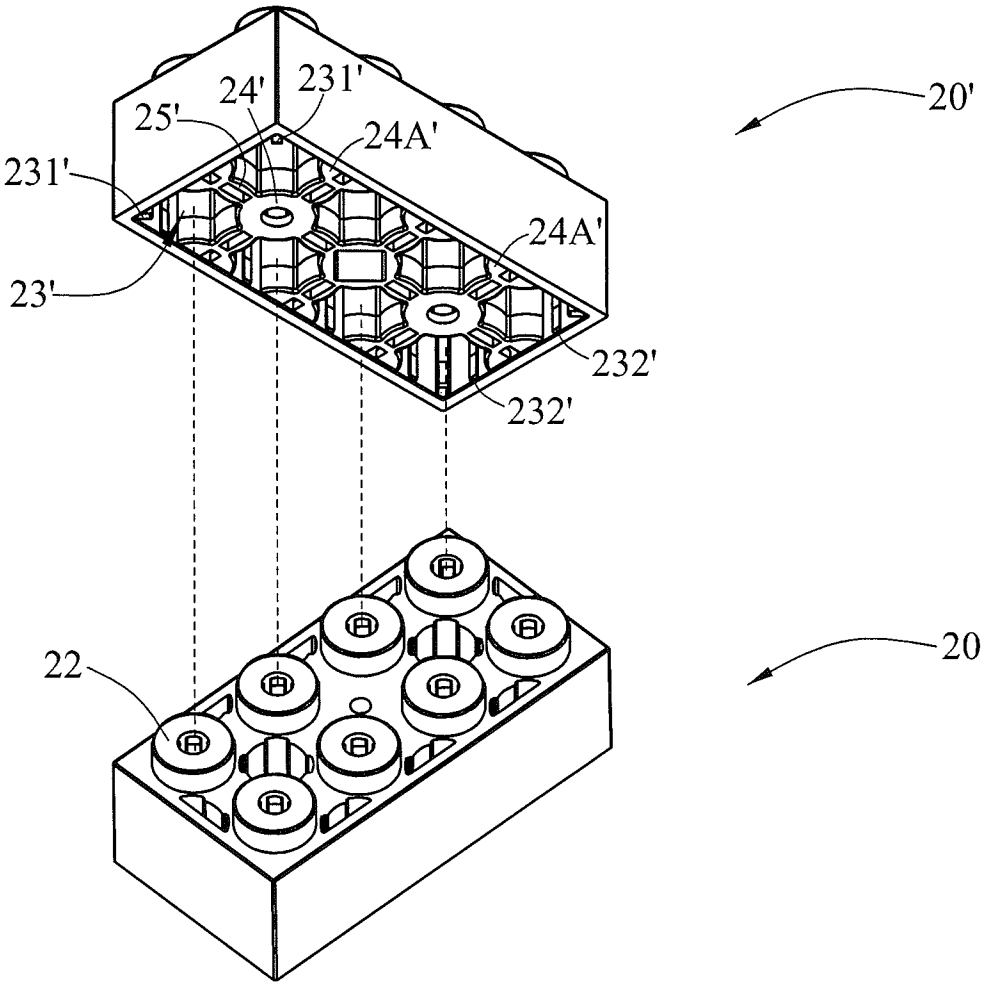
FIG. 2B is an explosive view showing two representative mating toy blocks 20 and 20' incorporating the present invention system, being joined in an example assembly fashion (among a number of combinations of assembly fashions)
Figure 2C:
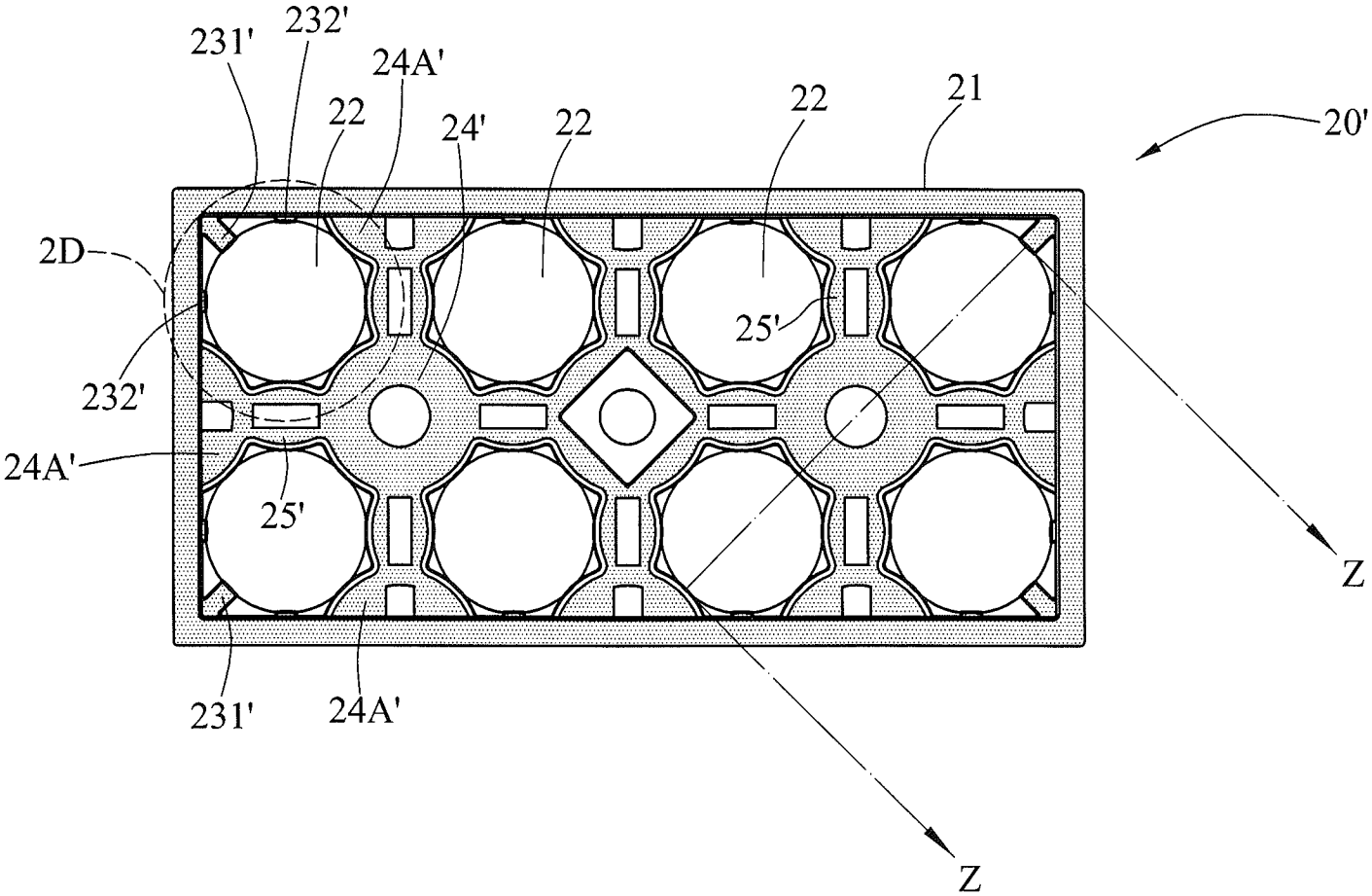
FIG. 2C is a cross-sectional plan view as cut at the bottom of the upper block 20', showing the engagement of the mating toy blocks 20 and 20'.
Figure 2D:
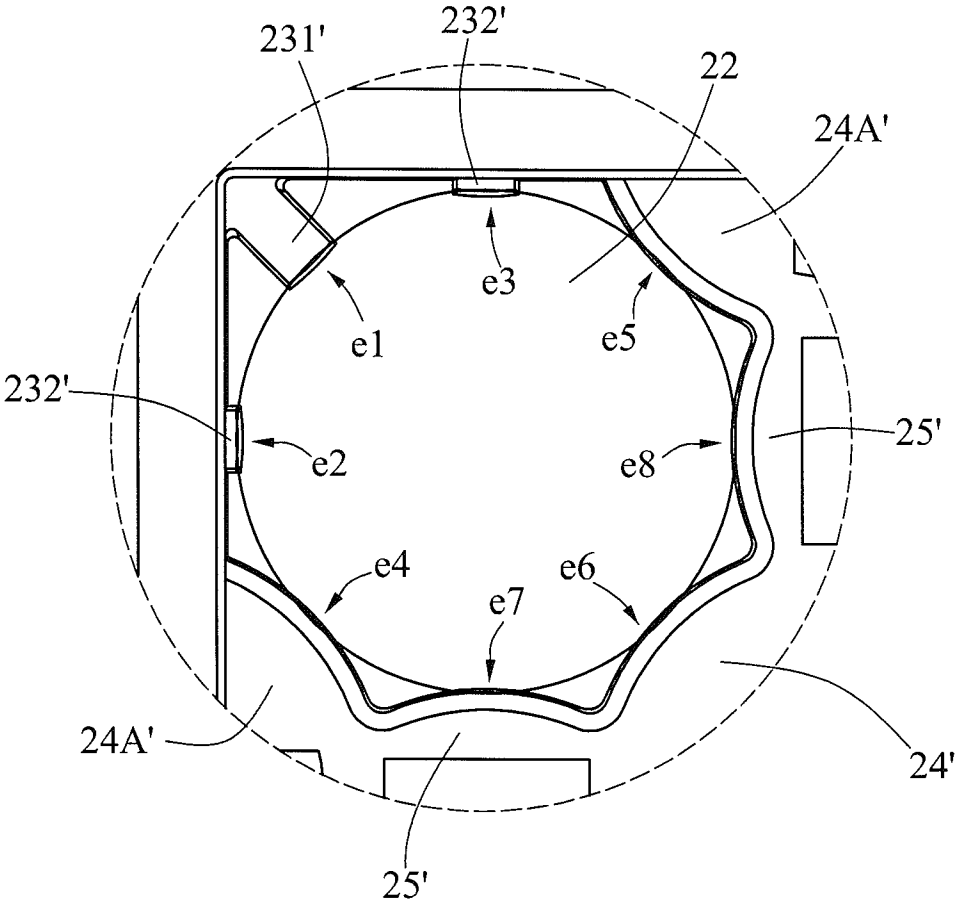
FIG. 2D is a partially enlarged view of FIG. 2C showing the engagement of eight abutment points (e1 through e8) per each engaged stud 22 as an example.

Referring to FIGS. 2B through 2D, to simplify the consistency of illustration here, the representative mating eight-stud toy blocks 20 and 20' of the present invention system, and the ones referred to above as being the first example embodiment of the present invention, are all assumed to be identical.

The studs 22 of the toy block 20 correspondingly mate with the recessed portions 23' of the toy block 20'. Upon inserting the studs 22 of the toy block 20 into the recessed portions 23' of the toy block 20', the engaged studs 22 of the toy block 20 each comes to abut at a total eight abutment points.

Taking an example on a portion inside the dotted circle 2D of FIG. 2C (also see the enlarged detail of this portion in FIG. 2D), the eight abutment points are:

- one abutment point e1 between the sidewall of the stud 22 and the corner stoppers 232';
- two abutment points e2 and e3 between the sidewall of the stud 22 and the edge stoppers 231';
- one abutment point e6 between the sidewall of the stud 22 and the bottom post 24';
- two abutment points e4 and e5 between the sidewall of the stud 22 and the semi-circle posts 24A'; and
- two abutting points e7 and e8 between the sidewall of the stud 22 and the rib pairs 25'.

The abutting points e1 and e6, e2 and e8, e3 and e7, and e4 and e5 are opposite to each other.

Comparing against the example of the prior-art toy block 10, which has only three abutment points for each engaged stud 12, the improved toy block 20 of the first embodiment incorporating the present invention system provides eight abutment points abutting against each engaged stud 22. Thus, the engagement and bond between assembled toy blocks 20 are much firmer than that of the prior-art toy block 10. As such, the block of the present invention will not easily come loose after use, because the degree of interference fit with the block of the present invention system can be minimized, thereby minimizing pre-mature friction wear and stress fatigue.

To be specific, compared to the three abutment points on each engaged stud 12 in the prior-art toy block 10, the average compression force, under the lesser degree of interference fit thus exerted against the eight abutment points on each of the engaged studs 22 in the toy block 20, need not be as great, because a smaller degree of interference fit for the improved block will result in as much bond as may be required. Thus, the bulge 11A shown in FIG. 1C will not occur on the exterior of the box-like sidewall 21. In addition, now that the bulge 11A is eliminated, with the gap 41 on FIG. 1D being minimized, the integrity of the entire block assembly and its service life can be further enhanced.

Figure 2E:
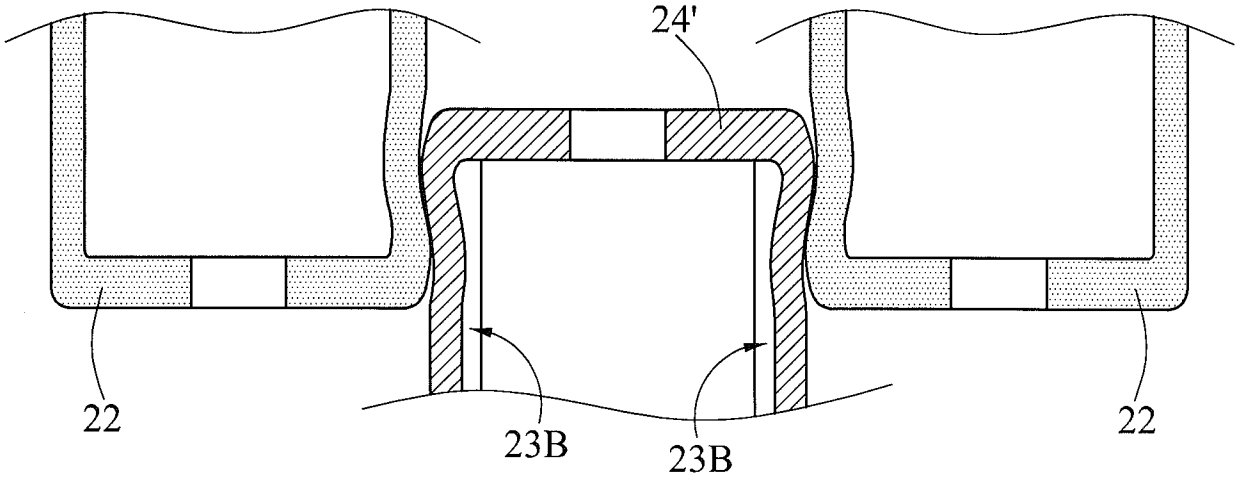
FIG. 2E is a cross-sectional view along line Z-Z of FIG. 2C, showing the intentional localized thinning of sidewall thickness on both the studs 22 and the bottom posts 24' at and along the line of their respective points of abutment, to make it easier facilitating a mutual squeeze and grasp inbetween the two.
Figure 5A:
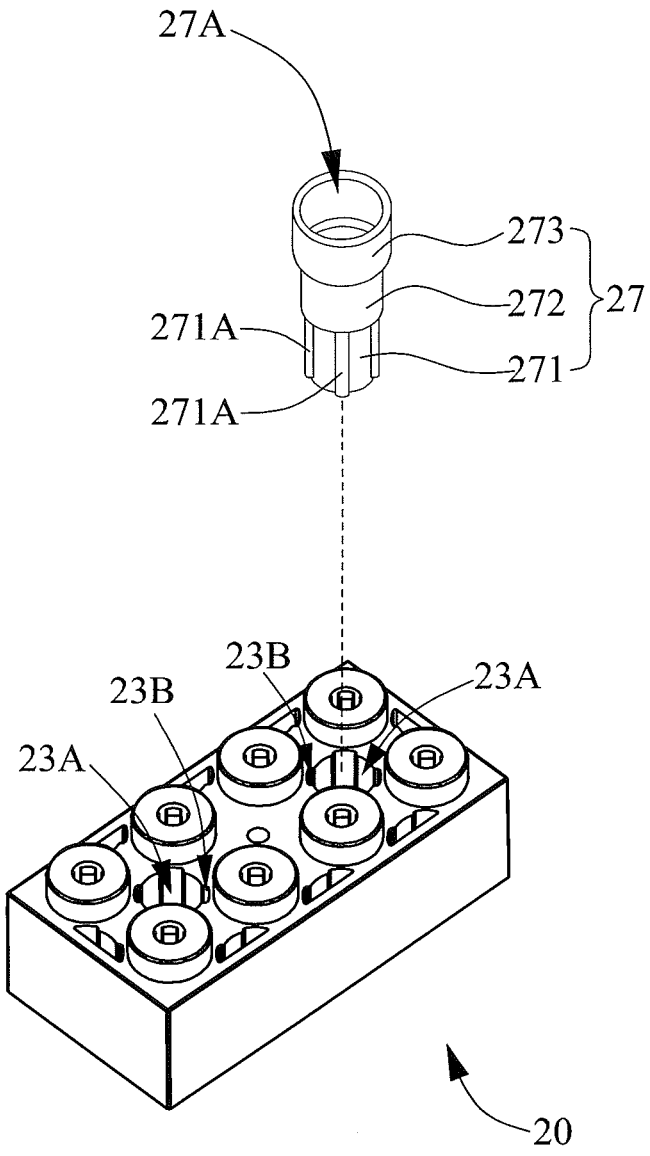
FIG. 5A is an explosive view showing a toy block 20 and a "keyed" axle 27 of a separate design being joined.

Furthermore, please refer to FIG. 2E and FIG. 5A. FIG. 2E is a cross-sectional view along line Z-Z of FIG. 2C. Please note: FIG. 5A shows a plurality of slots 23B cut into the inner side wall of the bottom post 24'. (The sectional view of the slot 23B is also shown in FIG. 2E.) The portion of the inner sidewall thickness of bottom post 24' forming slots 23B is made thinner than the wall portions of normal thickness. Specifically, the inner wall thickness at the abutment area on both the studs 22 and the bottom post 24' are intentionally thinned down locally at and along points of abutment, to form an undercut fit, making it easier for the studs 22 and the bottom post 24' to mutually squeeze and hence grasp with each other at their respective end cap area upon engagement, further aiding to the abutment bond.

In the above embodiment of FIG. 2A through FIG. 2C, the nominal diameter of the bottom post 24 can be expressed in the following Equation (1):

$$DP=PS\times\sqrt{2}-DS \quad (1)$$

Or, $DS=PS\times\sqrt{2}-DP$

DP=Nominal diameter of the bottom post 24
PS=Pitch between two studs 22
DS=Diameter of the stud 22

Please note that the center of the semi-circular post 24A will be where the stud center line crosses over the external edge of the box-like sidewall 21, and, its nominal radius is the same as that of the bottom post 24 (or half its diameter).

In addition, the center of the four corner stoppers 232 will be at the four external corners of the box-like sidewall 21 respectively. Its radius (thus the length as measured from the external corner of the box-like side wall) is the same as the radius (or half the diameter) of the bottom post 24.

Furthermore, the nominal width of the rib pair 25 measured across the tips of the arches, from one single rib to the far side of the other, can be expressed in the following equation (2):

$$WR=PS-DS \quad (2)$$

WR=Nominal width of the rib pair 25
PS=Pitch between two studs 22
DS=Diameter of the stud 22

Also, the nominal protrusion of the edge stoppers 231' from the inner side of the sidewall can be expressed in the following equation (3):

$$EP=\tfrac{1}{2}WR-ST \quad (3)$$

EP=Nominal protrusion of the edge stoppers 231'
WR=Nominal width of the rib pair 25.
ST=The sidewall thickness 21.

FIG. 3A is an explosive view showing the toy blocks 20 and 20' being joined together by an optional, separately designed Securing Device 22B.

Figure 3B:
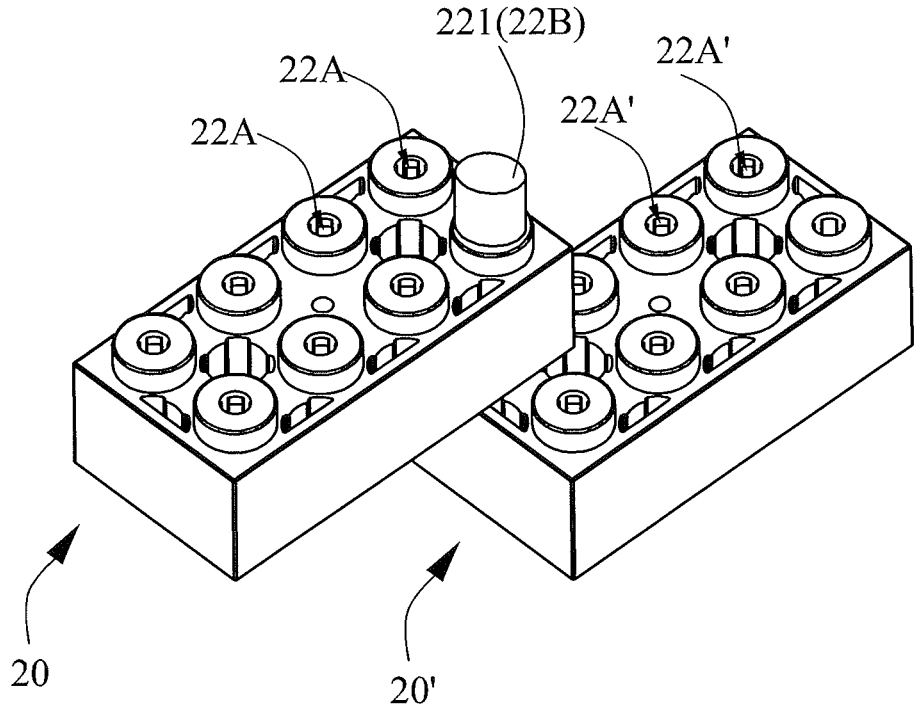
FIG. 3B is a perspective view showing the example mating toy blocks 20 and 20' as joined together by an optional, separately designed securing screw 221 and nut 222.

FIG. 3B is a perspective view showing the toy blocks 20 and 20' being joined together by the optional Securing Device 22B.

Referring to FIGS. 3A and 3B, the toy blocks 20 and 20' are of the same ones illustrated above as being the first embodiment. The optional Securing Device 22B includes a Screw 221 and a Nut 222. When only one of the Studs 22 of the toy block 20 is inserted into one of the recessed portions 23' of the toy block 20', the Screw 221 of the Securing Device 22B can be inserted into a Through-hole 22A on the Stud 22 and a Through-hole 22A' in the Stud 22', then further secured with the Nut 222. Thence, the assembly between the toy blocks 20 and 20' is positively secured.

Figure 3C:
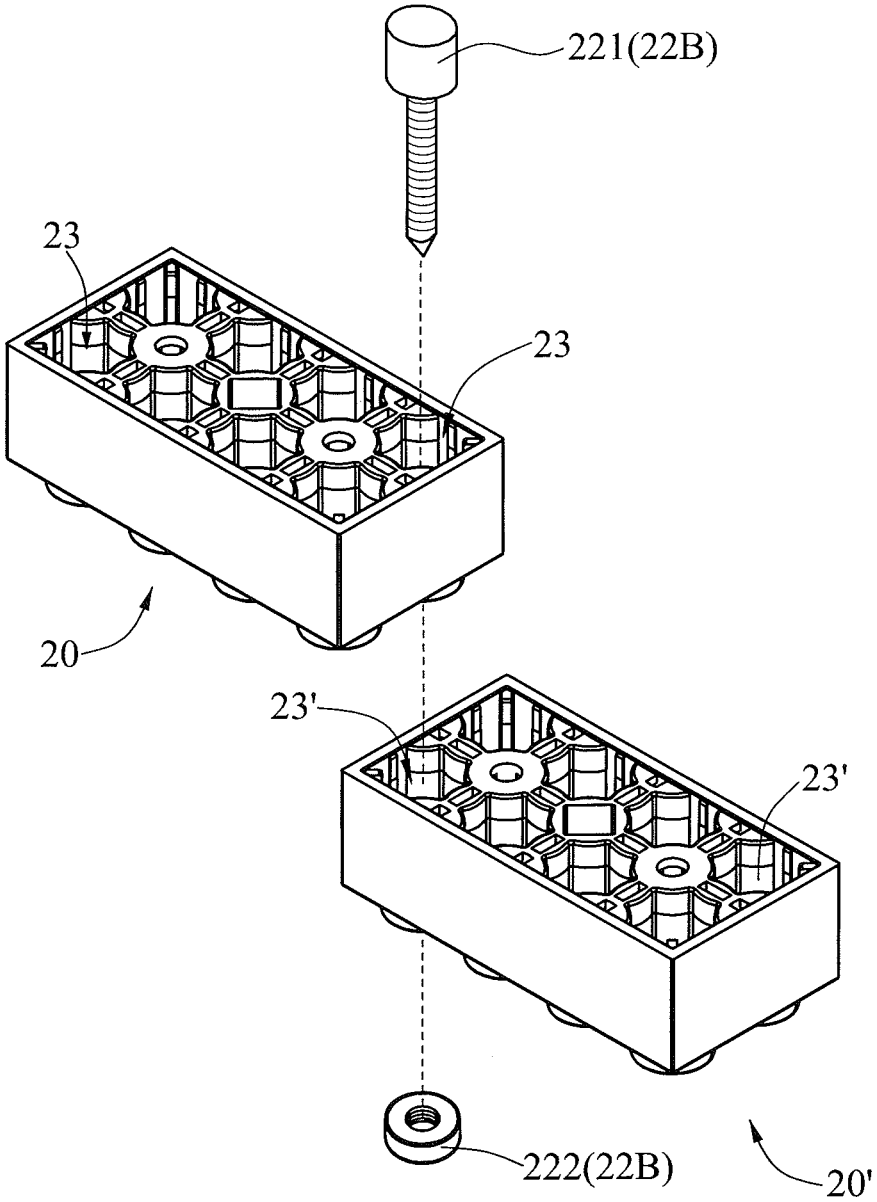
FIG. 3C is a perspective view showing the example mating toy blocks 20 and 20', and an optional securing screw 221 being joined under another fashion.

FIG. 3C is a perspective view showing the toy blocks 20 and 20' and the optional Securing Device 22B assembled in another fashion. Referring to FIG. 3C, the Screw 221 of the Securing Device 22B is passed from the recessed portion 23 and then through the recessed portion 23', and further secured with the Nut 222, thence positively securing the toy blocks 20 and 20' together.

Figure 1A:
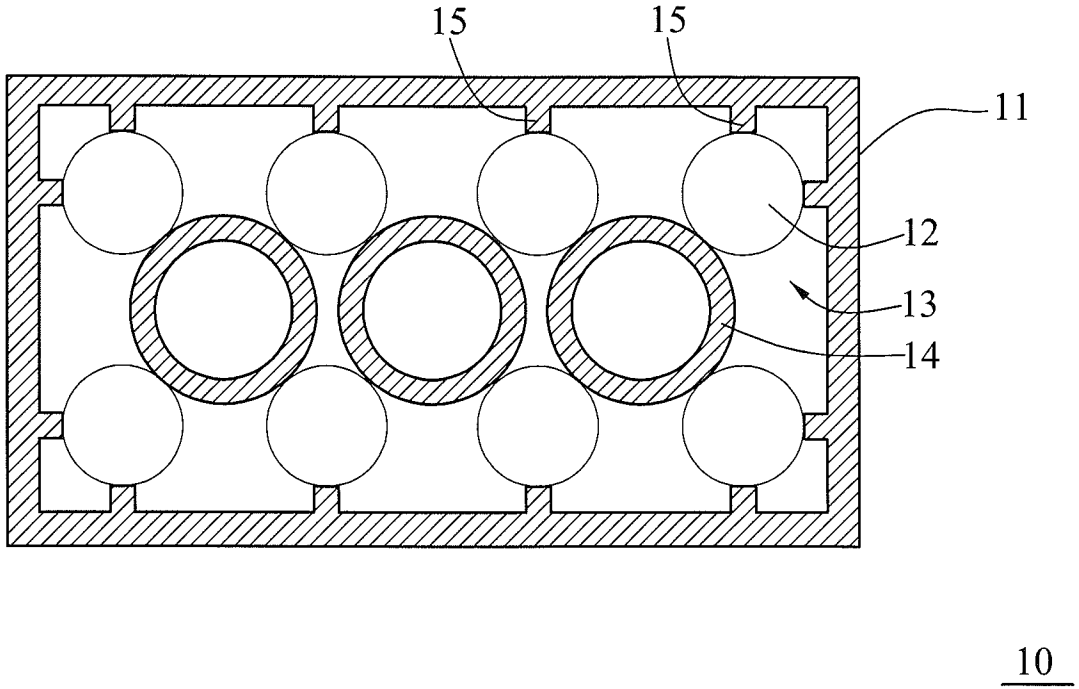
FIG. 1A(PRIOR ART)
FIG. 1A, is an example assembly fashion of the prior-art toy blocks 10 under their current engagement system (among a number of combinations of assembly fashions). It shows a "theoretical" cross-sectional schematic bottom view, cut at the bottom of the upper block of the example prior-art block 10 upon being assembled to its mating block one on top of the other.
Figure 1B:
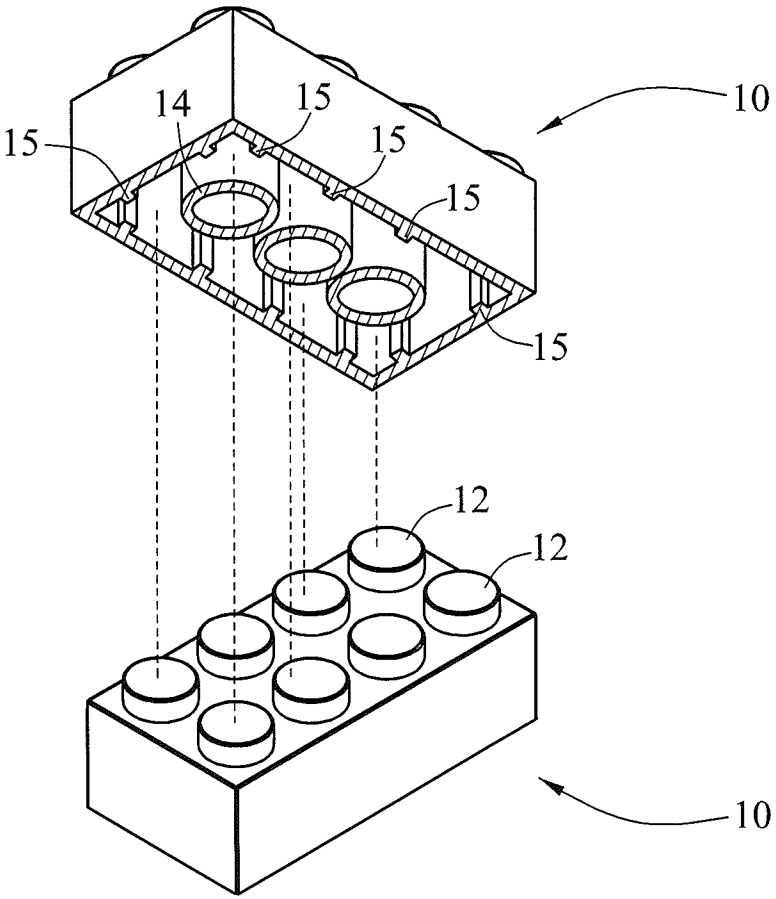
FIG. 1B(PRIOR ART)
FIG. 1B is an isometric view showing the prior-art toy block 10 and its mating block as detached from each other.
Figure 1C:
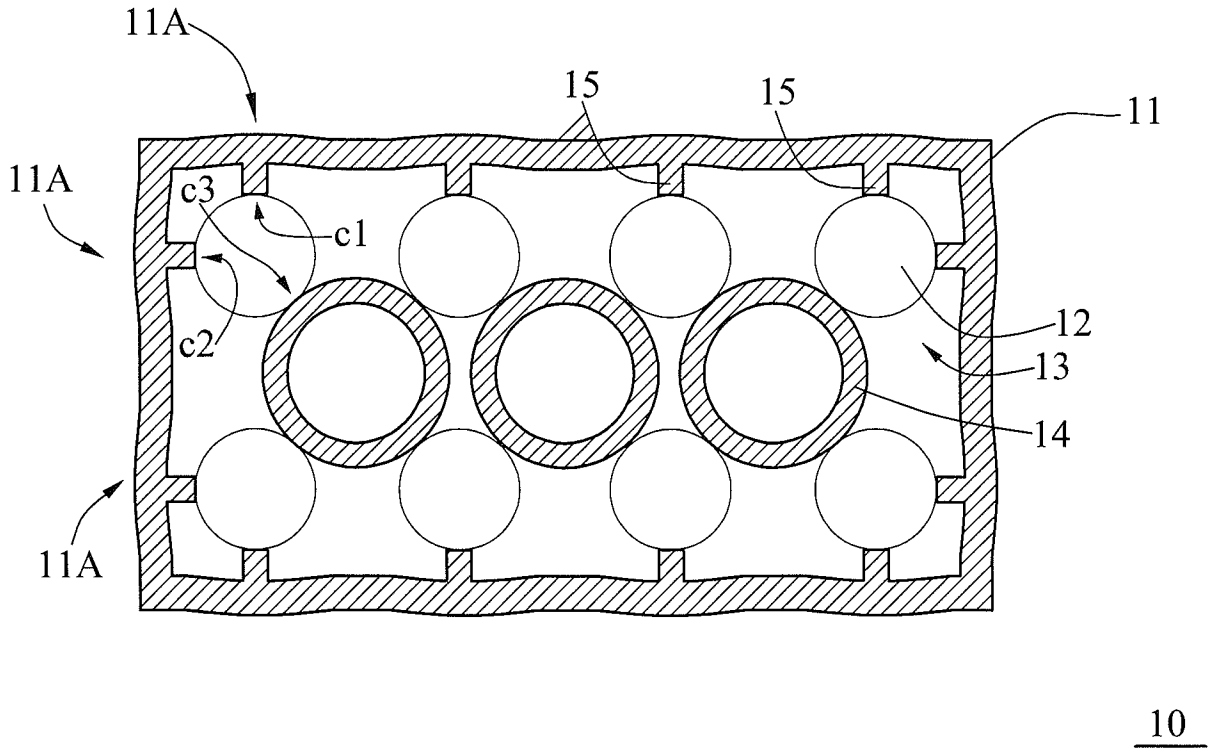
FIG. 1C(PRIOR ART)
FIG. 1C is an "actual" cross-sectional plane view showing that upon being assembled one on top of the other, the prior-art toy blocks 10 will result in a number of bulges 11A at their box-shaped sides.
Figure 1D:
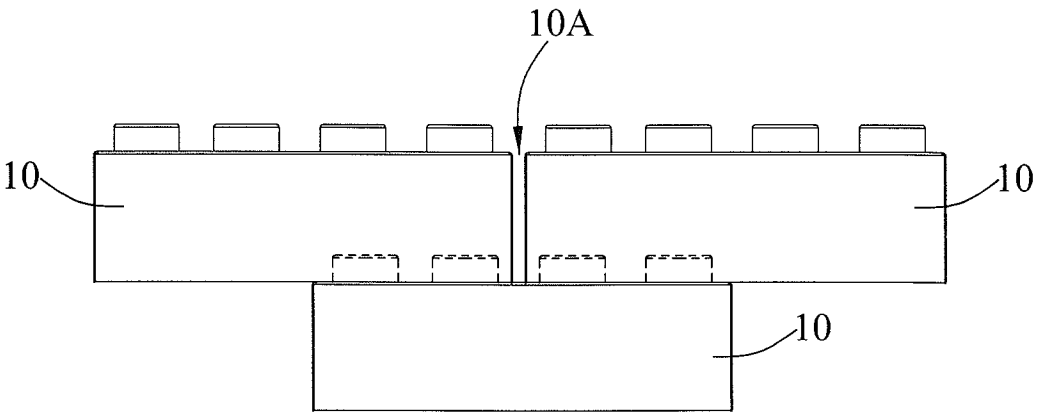
FIG. 1D(PRIOR ART)
FIG. 1D is a schematic side view showing an interlocked assembly of three mating prior-art toy blocks that, upon being joined together, the assembly will demonstrate a 10A, resulting in weaken a integrity of the entire assembly.
Figure 1E:
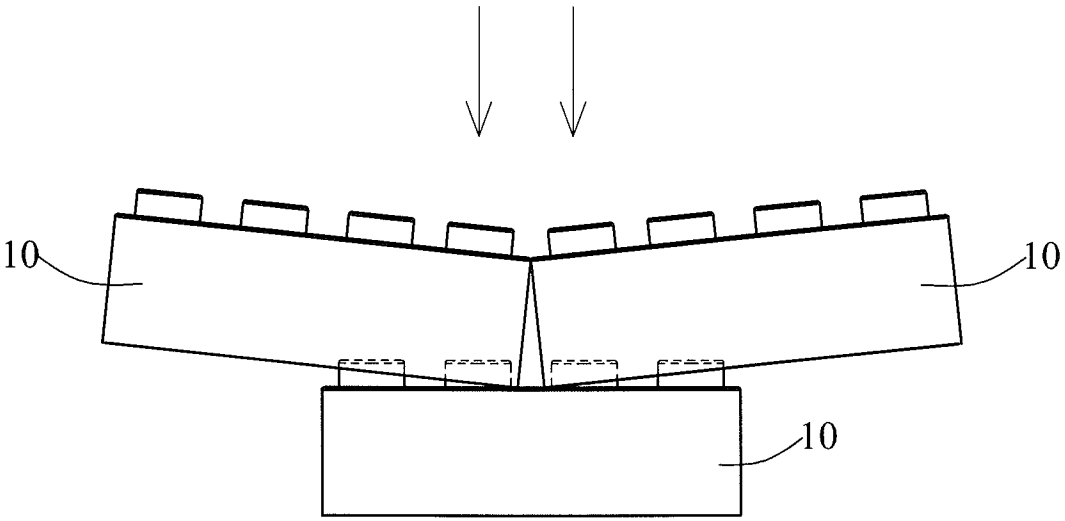
FIG. 1E(PRIOR ART)
FIG. 1E shows that the three mating prior-art toy blocks, while in their state of interlocked assembly, will tend to result in gaps at three locations, upon being subjected to an external force (or load)
Figure 4A:
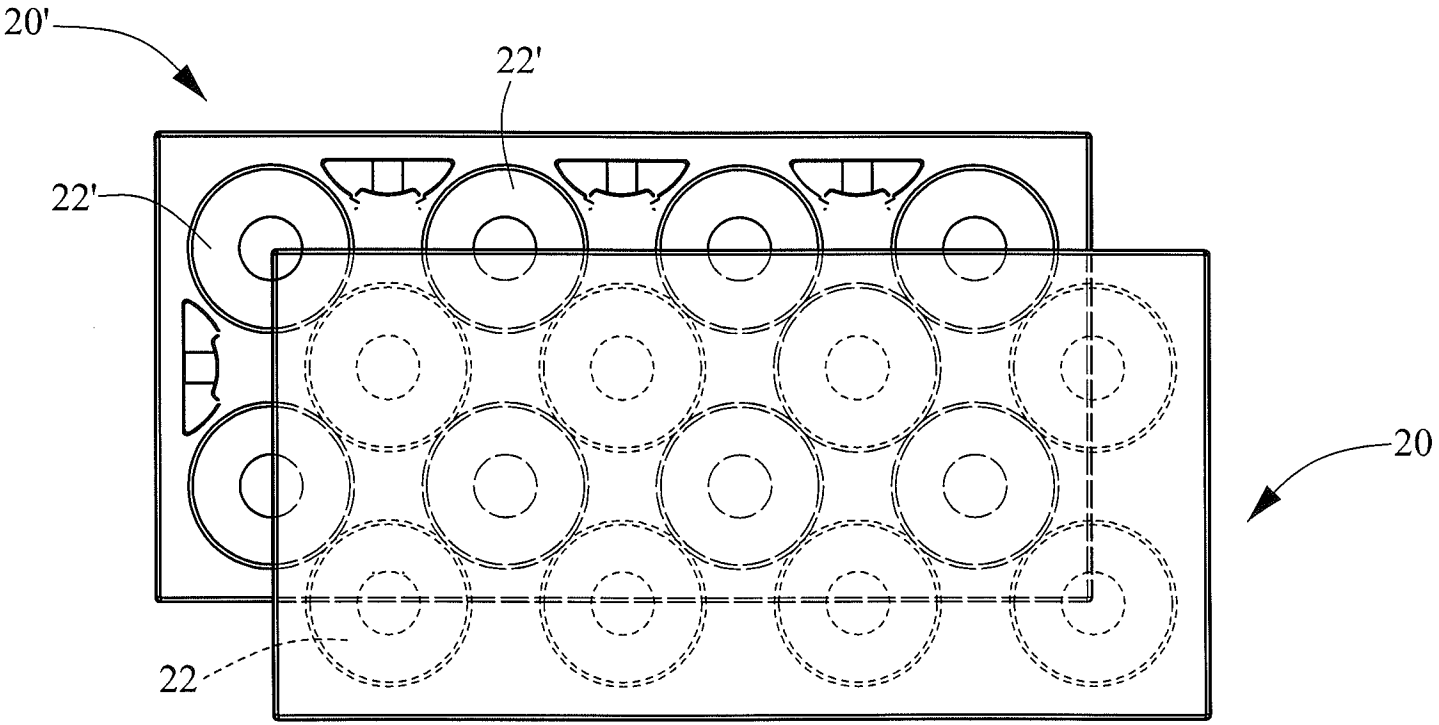
FIG. 4A is a schematic plan view, showing an example face-to-face assembly of two toy blocks, applicable when the diameter of the stud is designed to be the same as that of the bottom post, with one block off-set to the other by half a stud pitch (the distance inbetween the centers of neighboring studs) on both the vertical and horizontal directions, while the stud 22 of the toy block 20 being engaged next to the stud 22' of the toy block 20'.
Figure 4B:
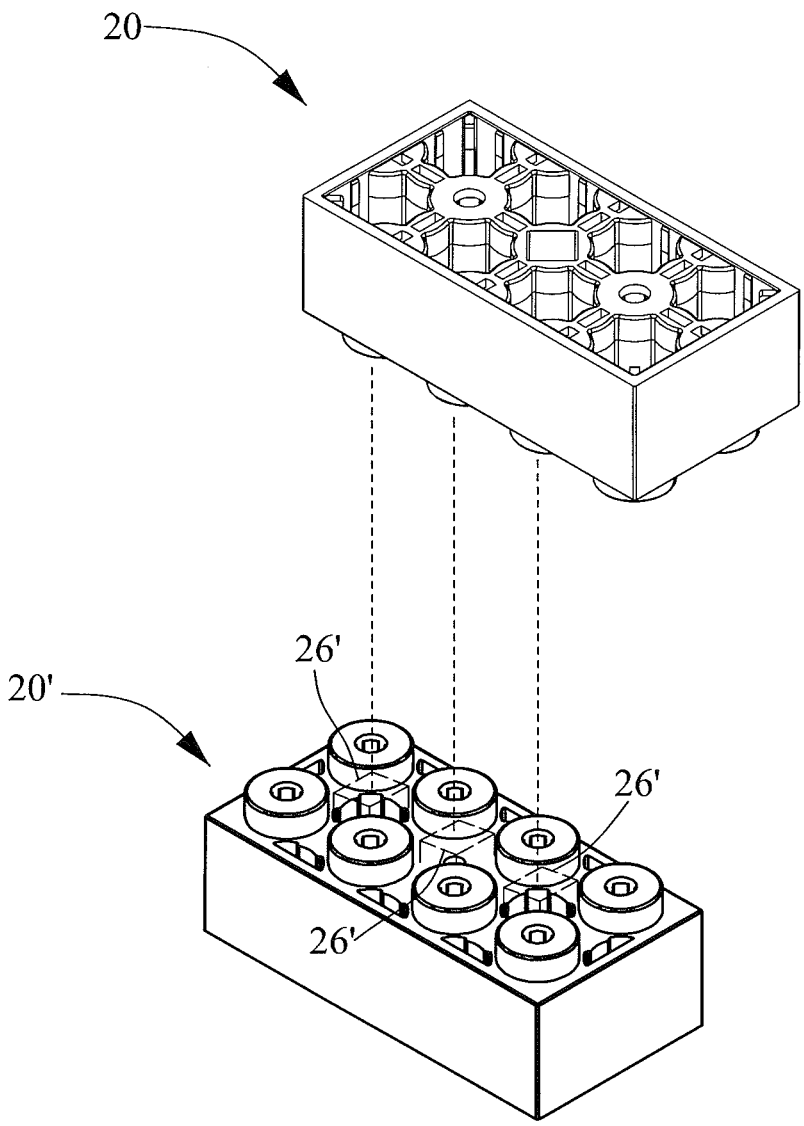
FIG. 4B is an explosive view showing the example face-to-face assembling, with the stud 22 of the toy block 20 being engaged next to the stud 22' of the toy block 20'.
Figure 4C:
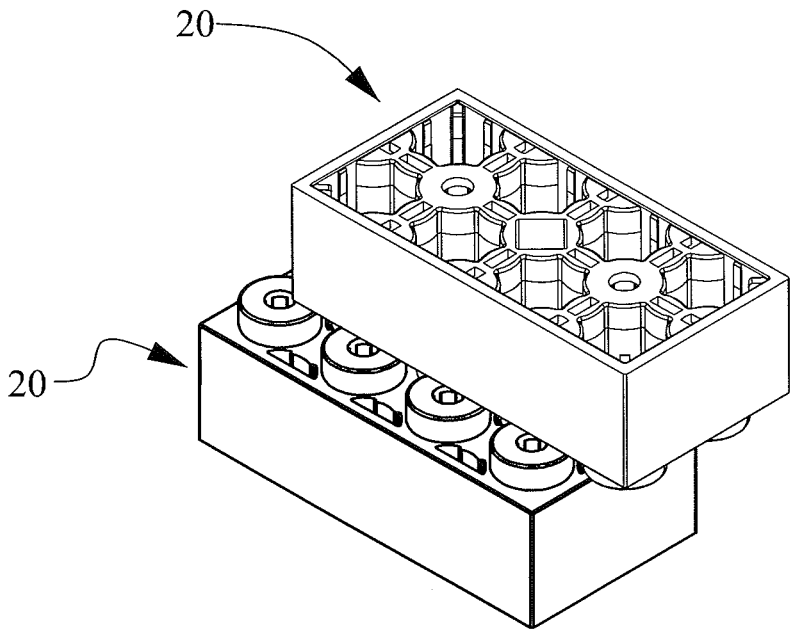
FIG. 4C is a perspective view of FIG. 4C after being assembled face-to-face as an example, showing one block offset to the other by half a stud pitch.

Referring to FIGS. 4A through 4C, the toy block 20' is the same as being the first embodiment of the present invention. The toy block 20' in accordance with the first embodiment is provided with a plurality of engaging spaces 26', as shown by dotted lines in FIG. 4B, each surrounded and defined by four of the studs 22. Under principle of Circle Square Packing, when the diameter of the Studs and that of the Bottom Posts are designed to be the same, upon inserting the Stud 22 of the toy block 20 into the engaging space 26', the engaged Stud 22 of the toy block 20 will be abutted against the Studs 22' of the mating toy block 20' by four abutment points, such that the Stud 22 of the toy block 20 can be engaged in the engaging space 26' face-to-face (or Stud-to-Stud) in a tight-fit fashion. In comparison to the kinds of assemblies between the prior-art toy blocks 10 commonly seen on the market as shown in FIG. 1A through FIG. 1B, their assembly of toy block 10 is limited to a top-to-bottom fashion only; while the toy block 20 of present invention system can be alternatively joined with the toy block 20' in a face-to-face fashion, hence better versatility with more numbers of combination for assembling.

Figure 5B:
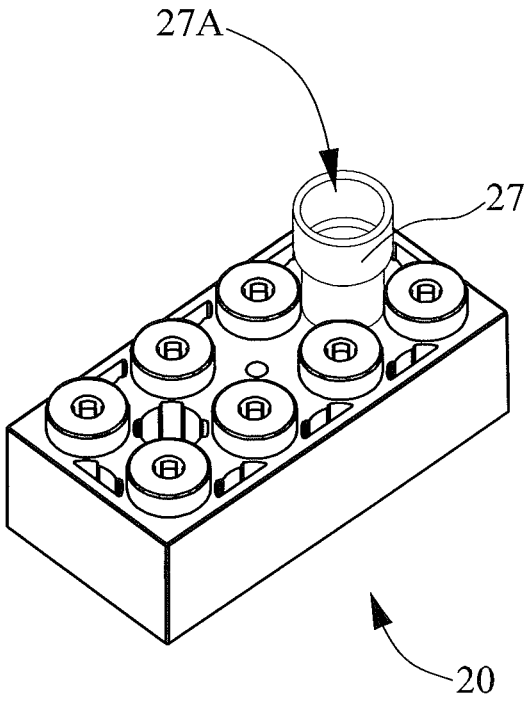
FIG. 5B is a perspective view showing a toy block 20 and an axle 27 as joined.

Referring to FIGS. 5A and 5B, as an naturally derived advantage, toy block 20 will allow (or receive) the insertion of an optional, separately designed Axle 27 incorporating four Keys 271A into the Notched Hole Opening 23A, which opening is so notched (per Slots 23B) in order to create a localized thin wall inside the Bottom Post 24' of FIG. 2E at and along the abutment points e4, e5, e6 of FIG. 2D.

The optional Axle 27 is shaped like a hollow pipe that can be divided into steppings of: first portion 271; a second portion 272; and a third portion 273. The four Keys 271A are located on the exterior of the first portion 271. A hole 27A is formed at a hollow space in the third portion 273. A Notched Hole Opening 23A is provided on the top side of the toy block 20, serving as an opening to make the inner hole inside Bottom Post 24. The Notches 23B are a natural consequence of the localized thinning of Bottom Post sidewall, allowing the insertion of portion 271 of the optional keyed Axle 27. The first portion 271 is inserted onto the Notched Hole Opening 23A of the toy block in a tight-fit fashion. The height of the second portion 272 is greater than that of the Stud 22. The second portion 272 has an outside diameter greater than that of the first portion 271, and the third portion 273 has an outside diameter greater than that of the second portion 272. The hole 27A in the third portion 273 may receive other rotary toy components available on the market such as wheels, rotors, propellers, and the like. Therefore, the user will be capable of more versatile assembly combinations using toy blocks 20 of present invention.

Figure 6A:
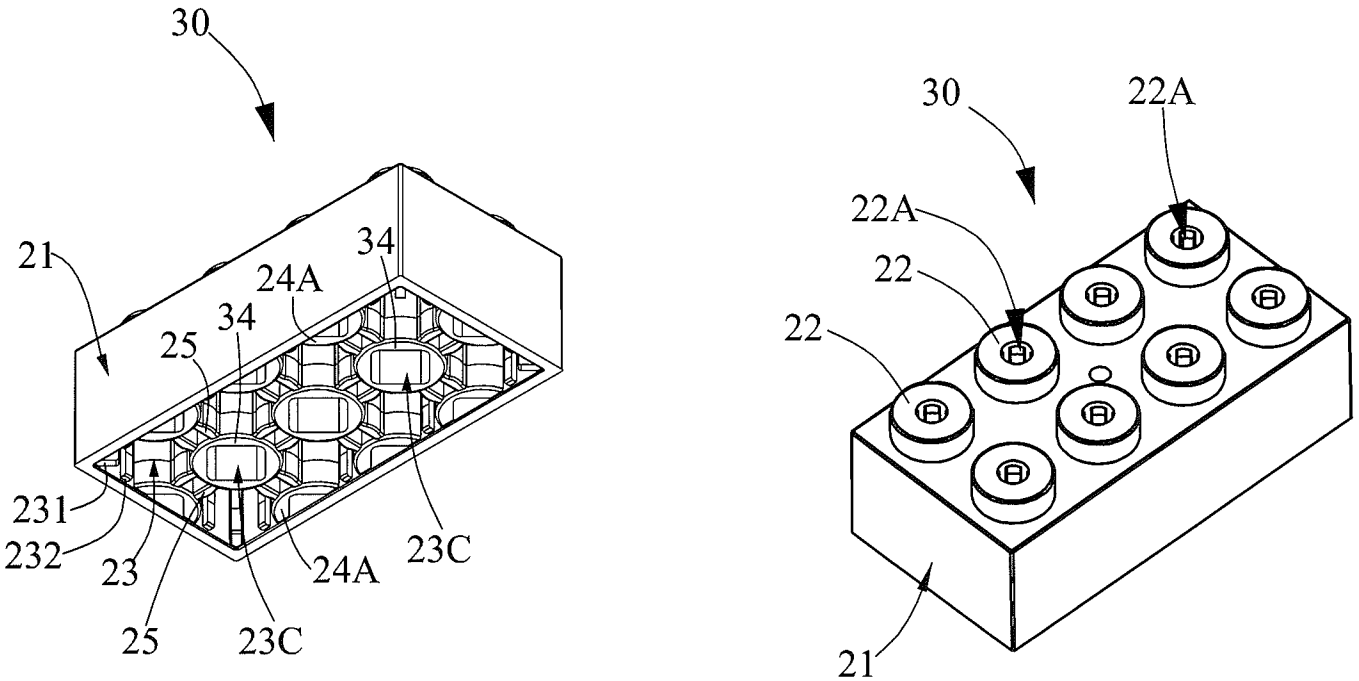
FIG. 6A is an isometric view of an alternative (or variation) toy block 30 as the second embodiment (or variation) of the present invention, when an opening such as the notched hole opening 23A of FIG. 5A on the land at the top side (or stud side) might be deemed undesirable under different marketing viewpoints.
Figure 6B:
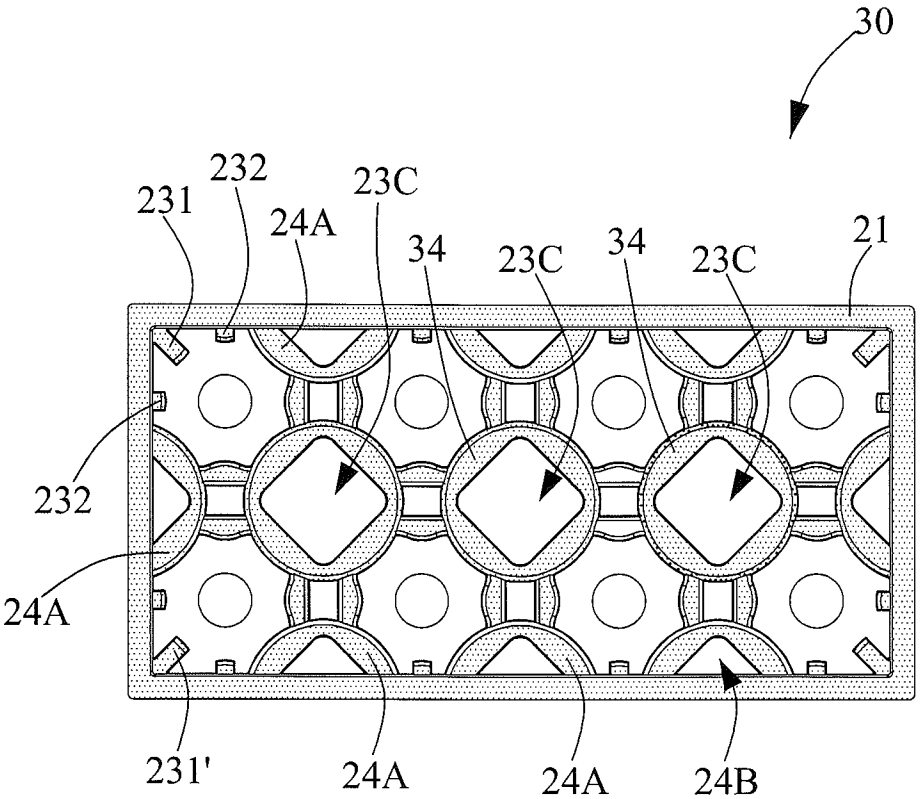
FIG. 6B is a bottom view of the alternative (or variation) toy block 30, which also has the same eight-abutment feature per e1 through e8 of FIG. 2D.

FIG. 6A and FIG. 6B show a toy block 30 as being the second embodiment of the present invention, for an alternative (or variation) to cases when the presence of openings (such as the Notched Hole 23A of FIG. 5A) on the land at the Stud side (the top side) might deem undesirable under different marketing viewpoint. In this second embodiment, the Bottom Post and the Semi-circle Posts can be so designed to eliminate their corresponding opening on the land at the Stud side (such as the Notched Hole 23A of FIG. 5A). Consequently, the End Cap 24 of FIG. 2A and the end cap of the Semi-circle Post 24A on the bottom side will both need to be removed, so as to allow the making of an inner blind hole inside the Bottom Post, and another inner hole inside the Semi-circle Post from the bottom side of the block respectively, serving as their respective material saver.

Hence, referring to FIG. 6A and FIG. 6B, a blind Square Hole 23*c* (or the like in terms of variation) is thus provided inside the Bottom Post 24 of the toy block 30; and a blind Triangular Hole 24B (or the like in terms of variation) is provided inside the Semi-circle Post 24A. These will literally make four arch-like sidewalls 34 on the Bottom Post, and two arch-like sidewalls 24A on the Semi-circle Post. The resulting arched sidewall each thence becomes an arched bridge, exhibiting a bridge-like springing and flexing effect under the compression force of the abutment coming from the mating Studs upon engagement, thereby improving the abutment bind without the need of an over-interference fit in order to achieve a desired firmness of bind, when Studs 22 is inserted into the recessed portions 23.

FIG. 3A is an explosive view showing the toy blocks 20 and 20' being joined together by an optional, separately designed securing device 22B.

FIG. 3B is a perspective view showing the toy blocks 20 and 20' being joined together by the optional securing device 22B.

Referring to FIGS. 3A and 3B, the toy blocks 20 and 20' are the same ones illustrated above as being the first embodiment. The optional securing device 22B includes a screw 221 and a nut 222. When only one of the studs 22 of the toy block 20 is inserted into one of the recessed portions 23' of the toy block 20', the screw 221 of the securing device 22B can be inserted into a through-hole 22A on the stud 22 and a through-hole 22A' in the stud 22', and then further secured with the nut 222. Thence, the assembly between the toy blocks 20 and 20' is positively secured.

FIG. 3C is a perspective view showing the toy blocks 20 and 20' and the optional securing device 22B assembled in another fashion. Referring to FIG. 3C, the screw 221 of the securing device 2213 is passed from the recessed portion 23 and then through the recessed portion 23', and is further secured with the nut 222, thence positively securing the toy blocks 20 and 20' together.

Referring to FIGS. 4A through 4C, the toy block 20' is the same as the first embodiment of the present invention. The toy block 20' in accordance with the first embodiment is provided with a plurality of engaging spaces 26', as shown by dotted lines in FIG. 4B, each surrounded and defined by four of the studs 22. Under the principle of Circle Square Packing, when the diameter of the studs and that of the bottom posts are designed to be the same and upon inserting the stud 22 of the toy block 20 into the engaging space 26', the engaged stud 22 of the toy block 20 will be abutted against the studs 22' of the mating toy block 20' by four abutment points, such that the stud 22 of the toy block 20 can be engaged in the engaging space 26' face-to-face (or stud-to-stud) in a tight-fit fashion. In comparison to the kinds of assemblies between the prior-art toy blocks 10 commonly seen on the market as shown in FIG. 1A through FIG. 1B, the assembly of the toy block 10 is limited to a top-to-bottom fashion only, while the toy block 20 of the present invention system can be alternatively joined with the toy block 20' in a face-to-face fashion, providing better versatility with more numbers of combination for assembling.

Referring to FIGS. 5A and 5B, as a naturally derived advantage, the toy block 20 will allow (or receive) the insertion of an optional, separately designed axle 27 incorporating four keys 271A into the notched hole opening 23A, which opening is so notched (per slot 23B) in order to create a localized thin wall inside the bottom post 24' of FIG. 2E at and along the abutment points e4, e5, e6 of FIG. 2D.

The optional axle 27 is shaped like a hollow pipe that can be divided into: a first portion 271; a second portion 272; and a third portion 273. The four keys 271 A are located on the exterior of the first portion 271. A hole 27A is formed at a hollow space in the third portion 273. A notched hole opening 23A is provided on the top side of the toy block 20, serving as an opening to make the inner hole inside the bottom post 24. The notches 23B are a natural consequence of the localized thinning of the bottom post sidewall, allowing the insertion of the first portion 271 of the optional keyed axle 27. The first portion 271 is inserted onto the notched hole opening 23A of the toy block in a tight-fit fashion. The height of the second portion 272 is greater than that of the stud 22. The second portion 272 has an outside diameter greater than that of the first portion 271, and the third portion 273 has an outside diameter greater than that of the second portion 272. The hole 27A in the third portion 273 may receive other rotary toy components available on the market such as wheels, rotors, propellers, and the like. Therefore, the user will be capable of more versatile assembly combinations using the toy blocks 20 of the present invention.

FIG. 6A and FIG. 6B show a toy block 30 being the second embodiment of the present invention, for an alternative (or variation) to cases when the presence of openings (such as the notched hole opening 23A of FIG. 5A) on the land at the stud side (the top side) might be deemed undesirable under a different marketing viewpoint. In this second embodiment, the bottom post and the semi-circle posts can be so designed to eliminate their corresponding opening on the land at the stud side (such as the notched hole opening 23A of FIG. 5A). Consequently, the end cap 24 of FIG. 2A and the end cap of the semi-circle post 24A on the bottom side will both need to be removed, to allow making of an inner blind hole inside the bottom post and another inner hole inside the semi-circle post from the bottom side of the block respectively, serving as their respective material saver.

Hence, referring to FIG. 6A and FIG. 6B, a blind square hole 23*c* (or the like in terms of variation) is thus provided inside the bottom post 24 of the toy block 30, and a blind triangular hole 24B (or the like in terms of variation) is provided inside the semi-circle post 24A. These will literally make four arch-like sidewalls 34 on the bottom post and two arch-like sidewalls 24A on the semi-circle post. The resulting arched sidewall becomes an arched bridge, exhibiting a bridge-like springing and flexing effect under the compression force of the abutment coming from the mating studs upon engagement, thereby improving the abutment bond without the need of an over-interference fit in order to achieve a desired firmness of bond, when the studs 22 are inserted into the recessed portions 23.

Figure 6C:
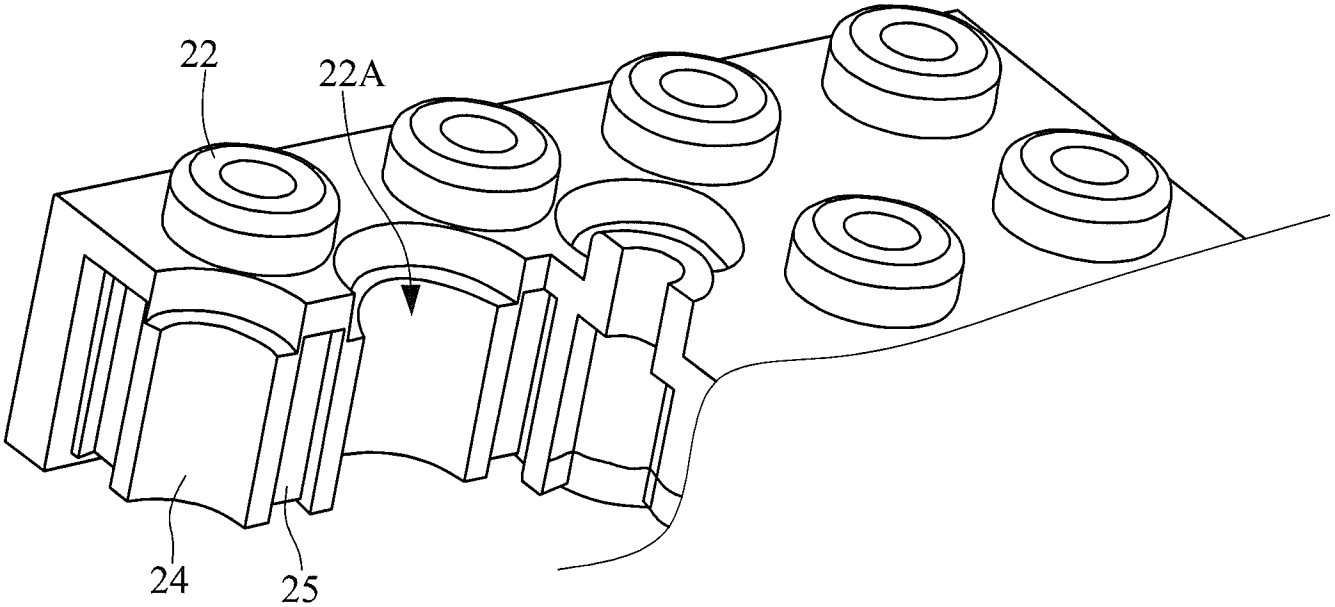
FIG. 6C shows another advantage of the rib pair 25.

Please refer to FIG. 6C which shows another advantage of the rib pairs 25 of FIG. 2A, where they come to hold the bottom post 24. This occurs when the bottom post 24 is required to be stepped down away from its attaching land on the stud side. There are cases of application when a through-hole 22A is required inside of the bottom post 24, to receive an outside component, such as a shaft available on the market. In order to meet the specification of the shaft as is, it is required that the through-hole 22A inside of the bottom post 24 be shorten, thereupon making the bottom post to become so much stepped down that it looses its attaching land on the stud side. This is where the advantage of the rib pairs 25 comes in, because the bottom post 24 is still being attached by the four rib pairs 25 (or the like in terms of attaching), holding it in place.

Figure 6D:
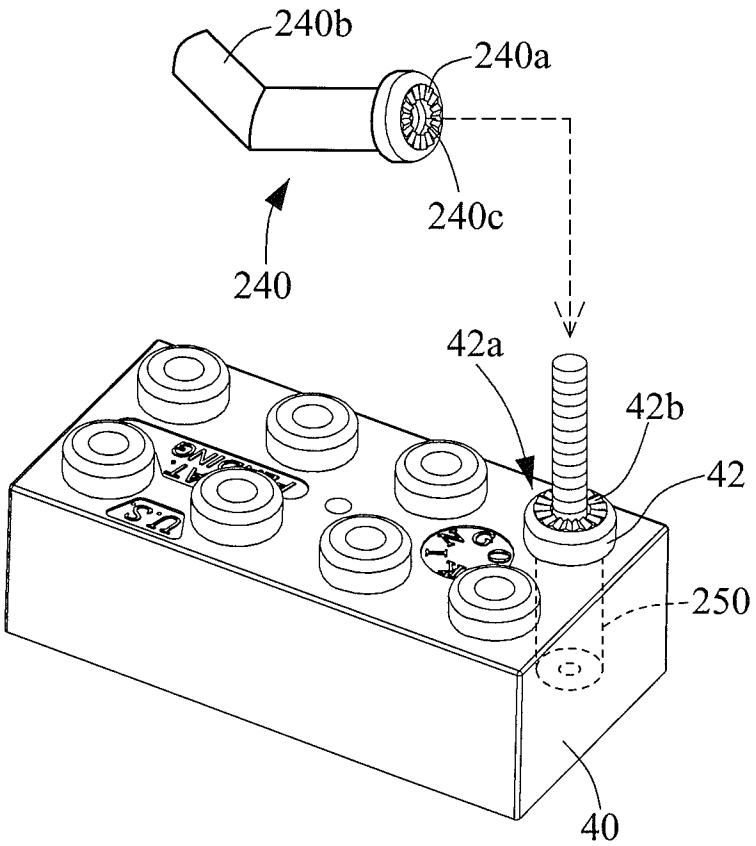
FIG. 6D shows another variation of the embodiment.

FIG. 6D shows another representative eight-stud toy block 40 as being the third embodiment of the present invention. The toy block 40 includes eight studs 42, and at least one of the studs 42 at the corner has a serration (or toothed plane) 42*a* to its top. The serration 42*a* has a plurality of teeth 42*b*. The teeth 42*b* can be used as a tooth-locker washer or for angular positioning. For example, an optional, separately designed angled connector 240 with serrations at its bottom surface 240*a* is provided [M] and the toothed bottom surface 240*a* (or mating serration) is mating with the serration 42*a* on the stud. By meshing of the serration 42*a* with the bottom surface 240*a*, the pointing direction of the upper portion 240*b* of the angled connector 240 can be adjusted. Furthermore, an attaching screw 250 can be screwed to a threaded hole 240*c* of the angled connector 240 to tighten and lockup to a fixed angular position. Alternatively, the angled connector will be allowed to ratchet upon easing of the screw. Another optional use for the serration 42A is to serve as a tooth lock washer during other applications, such as when a nut is used in lieu of the angled connector.

As a variation, an example eight-stud toy block of this invention can also be designed to have different diameters inbetween the studs and the bottom post. Considering the proportion of the stud diameter against that of the bottom post and taking into consideration the balance of leverage at the bottom plan of the toy block where two mating toy blocks may join with the stud 22 by its height against that of the bottom post 24, it could be desirable to maximize the diameter of the bottom post. Under the principle of Circle Square Packing, if one were to crop a toy block of a size similar to the prior-art array of two rows by four studs each, the stud pitch ("PS" of Equation 1) will be half that of the nominal width of such a toy block. If one were to factor in a minimum spacing (BPS) inbetween the bottom posts and its neighboring ones, serving as a minimum wall thickness for the tool steel of its injection mold, the ratio of the stud 22 versus the bottom post 24 will result in roughly 4.9:6.4 as explained below.

Taking one example of an eight-stud toy block with a nominal width of 16 mm as commonly being adopted on the market, the stud pitch (PS of Equation 1) will equal 8 mm. Assuming a minimum spacing of 1.5 mm inbetween the bottom posts 24 for tool steel integrity, the maximum nominal bottom post diameter (DP) will then become:

=stud pitch (*PS*)−bottom post spacing (*BPS*); or =6.5 mm the nominal stud diameter (*DS* of Equation 1) then becomes: $=P=PS\times\sqrt{2}-DP$; or about 4.812 mm.

If one were to further factor in a 0.10 mm to the bottom post diameter for purpose of an interference fit, with 6.50 mm being used as the "actual" diameter, the "nominal"diameter of the bottom post 24 (DP) will then become 6.40 mm. Accordingly, by recalculation, the stud diameter (DS) in turn becomes about 4.912 mm; and hence, the approximate ratio of 6.4:4.9 is thus derived.

Towards meeting this ratio of 6.4:4.9, the length and width of the relative dimensions on the various parts of the toy block 20 has been recalculated and determined to be viable both in terms of the strength of the plastics on the block and the tool steel integrity.

Towards meeting this ratio of 6.4:4.9, the length and width of the relative dimensions on the various part of the a toy block 20 has been recalculated and determined to be viable both in terms of the strength the plastics on the block, and the tool steel integrity.

What is claimed is:

1. A toy block comprising:

a body made of a plastic material and having four sidewalls;

a plurality of studs at a top side;

a plurality of recessed portions at a bottom side;

a plurality of bottom posts at the bottom side, wherein the plurality of bottom posts is surrounded by the plurality of recessed portions and ready to abut an engaged stud of a mating toy block;

a plurality of semi-circular posts at the bottom side, wherein the plurality of semi-circular posts protrude from the four sidewalls and ready to abut the engaged Stud of the mating toy block;

a plurality of rib pairs connecting between two of the plurality of bottom posts, or between the plurality of bottom posts and the plurality of semi-circular posts, wherein the plurality of rib pairs have either a flat wall or a protrusion on rib exteriors thereof in a corresponding recessed portion and ready to abut the engaged stud of the mating toy block;

a plurality of edge stoppers in the plurality of recessed portions at an inner side of the four sidewalls and ready to abut the engaged Stud of the mating toy block; and a plurality of corner stoppers in the plurality of recessed portions, at four corners of the inner side of the four sidewalls, and aligned towards a center of a nearest bottom post respectively and ready to abut the engaged stud of the mating toy block.

2. The toy block of claim 1, wherein a through-hole passes through each stud allowing a securing device to positively secure the body and the mating toy block together.

3. The toy block of claim 1, wherein the plurality of bottom posts and the plurality of semi-circle posts are provided with an end cap respectively, serving to grasp against the engaged stud of the mating block upon being engaged.

4. The toy block of claim 1, wherein a sidewall thickness of holes inside the plurality of bottom posts and inside the plurality of studs are reduced locally at and along mutual abutment points, to facilitate easier mutual squeezing, thence grasping, upon being engaged.

5. The toy block of claim 1, wherein the plurality of rib pairs has hollow walls with sides abutting the engaged stud of the mating block.

6. The toy block of claim 1, wherein the plurality of rib pairs holds a stepped-down bottom post in place when a shortened, stepped-down through-hole is made inside of the stepped-down bottom post.

7. The toy block of claim 1, wherein a diameter of each stud is the same as that of each bottom post, wherein a plurality of engaging spaces on a stud side surround the plurality of studs, and wherein upon inserting the engaged stud of the mating toy block into the plurality of engaging spaces on the stud side in a face-to-face fashion, the engaged stud of the mating toy block abuts against a sidewall of the plurality of studs.

8. The toy block of claim 1, wherein a blind square hole is provided inside each bottom post, and wherein a blind triangular hole is provided inside each semi-circle post.

9. The toy block of claim 1 further comprising a notched opening derived as a consequence out of localized reduction of an interior wall thickness of each bottom post; and a keyed axle inserted in the notched opening.

10. The toy block of claim 9, wherein the keyed axle attaches to a rotational toy component.

11. The toy block of claim 1, wherein at least one of the plurality of studs has a toothed plane, and wherein the toothed plane has a plurality of teeth or serrations.

* * * * *